US011760123B2

(12) United States Patent
Pust

(10) Patent No.: US 11,760,123 B2
(45) Date of Patent: Sep. 19, 2023

(54) EXTENSION FOR PENCILS WITH WORN LEADS

(71) Applicant: Manriko Pust, Angermuende (DE)

(72) Inventor: Manriko Pust, Angermuende (DE)

( * ) Notice: Subject to any disclaimer, the term of this patent is extended or adjusted under 35 U.S.C. 154(b) by 74 days.

(21) Appl. No.: 17/601,488

(22) PCT Filed: Apr. 15, 2020

(86) PCT No.: PCT/EP2020/025168

§ 371 (c)(1),
(2) Date: Oct. 5, 2021

(87) PCT Pub. No.: WO2020/211979

PCT Pub. Date: Oct. 22, 2020

(65) Prior Publication Data

US 2022/0203751 A1 Jun. 30, 2022

(30) Foreign Application Priority Data

Apr. 18, 2019 (DE) ..... 102019002839.2

(51) Int. Cl.
*B43K 23/10* (2006.01)
*B43K 19/14* (2006.01)
*B43K 25/02* (2006.01)

(52) U.S. Cl.
CPC ..... *B43K 23/10* (2013.01); *B43K 19/14* (2013.01); *B43K 25/02* (2013.01)

(58) Field of Classification Search
CPC ..... B43K 23/00; B43K 23/016; B43K 23/10
USPC ..... 401/88
See application file for complete search history.

(56) References Cited

U.S. PATENT DOCUMENTS 5,779,381 A * 7/1998 Muelver ..... B43K 23/016 401/75
6,276,854 B1 * 8/2001 Mullins ..... B43K 23/016 D19/204
6,663,305 B2 * 12/2003 Poulos ..... B43K 23/02 D19/135

(Continued)

FOREIGN PATENT DOCUMENTS

DE 103216 C 8/1898
DE 1770517 U 7/1958

(Continued)

*Primary Examiner* — David P Angwin
*Assistant Examiner* — Bradley S Oliver
(74) *Attorney, Agent, or Firm* — Laurence A. Greenberg; Werner H. Stemer; Ralph E. Locher

(57) ABSTRACT

An extension for pencils with wearing leads, formed from a thin-walled hollow profile. The inner cross section is adapted to the shape of a pencil. One or more slots of appropriate length in the longitudinal direction at an end of the extension where the tapered end of the pencil is located and a slight linear reduction in the cross section approximately over the length of one or more slots. Longitudinal raised sections in the form of triangular, square, and/or semi-circular prisms, directed inwardly. The height of the raised sections may increase in the direction of insertion of the pencil and dig into the pencil slightly when the pencil is inserted. The height of the raised sections is reduced linearly to zero at the end of the extension where the pencil is inserted. Inwardly bent or protruding retaining springs arranged on the inner surface of the extension.

5 Claims, 2 Drawing Sheets

(56) References Cited

U.S. PATENT DOCUMENTS

| | | | | |
|---|---|---|---|---|
| 8,408,832 | B2 * | 4/2013 | Andochick | B43K 25/00 401/48 |
| 8,900,684 | B2 | 12/2014 | Buelow | |
| 9,656,508 | B2 * | 5/2017 | Moeck | B43L 23/08 |
| 2015/0041350 | A1 | 2/2015 | Moeck | |

FOREIGN PATENT DOCUMENTS

| | | | |
|---|---|---|---|
| DE | 202010018125 | U1 | 3/2014 |
| DE | 202015100395 | U1 | 4/2016 |
| WO | 0143988 | A1 | 6/2001 |

* cited by examiner

EXTENSION FOR PENCILS WITH WORN LEADS

FIELD AND BACKGROUND OF THE INVENTION

The invention relates to the extension of partially or highly used pencils.

It is known that, for example, pencils and colored pencils with leads that wear out have to be sharpened and become shorter in the process.

In the case of partially used and consequently shortened pencils with worn leads, the handling deteriorates progressively due to the limited possibilities for holding and guiding the pencil in the hand.

This deteriorating handling is problematic, in particular when these pencils need to be available quickly and must be easy to grip firmly.

This applies, for example, to carpenter's pencils.

In the case of highly used carpenter's pencils, this also includes the problem of extremely limited rapid availability since these pencils are usually carried in the folding ruler pocket of carpenter pants, which are located on the outer side of the pant leg at a grippable height and which have a large depth with respect to the width so that the ruler stands upright and protrudes slightly over the upper opening of the pocket and thus can be grabbed easily at any time.

If there is also a partially or highly used carpenter's pencil in this pocket, then the ability to grasp it quickly is severely limited since the upper end of the pencil is then located below the opening of the pocket and grabbing it with multiple fingers becomes increasingly difficult the shorter the pencil is.

In the case of a very short pencil, it is also possible for the pencil to become wedged in the pocket.

In general, this also applies to separate, special pencil pockets, which usually have a shape similar to that of the ruler pocket but which is adapted to the sizes of the pencils.

A possible remedy is a clip at the blunt end of the pencil, which, however, makes it more difficult to insert into the ruler pocket or a special pencil pocket and also increases the risk of unintentional removal.

For these reasons, it is currently common practice to dispose of the pencils far before their full capacity has been used, which is above all an ecological problem and—also in view of the low price of a pencil—ultimately an economic problem.

Hitherto, no practical technical solutions have been known for this problem.

The German patent application 103216 from 1898 describes a sleeve for slate pencils in which the slate pencils are held by means of flexible tongues.

Also known is the solution according to German Utility Model 1 770 517, which proposes inserting the entire length of a new pencil into a metal sleeve. In this case, this metal sleeve has a slot in order to push a pencil that has retracted too far into the sleeve back out again by means of a knife or a nail.

DE 20 2010 018 125 discloses an actuating means comprising an elongate cavity and an opening in the cavity to the surrounding environment, into which a correspondingly elongated object, such as, for example, a carpenter's pencil, can be inserted at least partially and held in place.

This actuating means is used in a tool for use in installing a vapor barrier collar, wherein the vapor barrier collar comprises a series of surface elements, including side surface elements, extending mainly along a longitudinal axis, and upper and lower surface elements extending mainly along a lateral axis perpendicular to the longitudinal axis, wherein each surface element has two end edges adjacent to a first edge of the surface element, wherein the surface elements are joined together in connections, which extend along the end edges, and wherein installation means are provided along the first edges of the surface elements, wherein the installation means extend continuously along the entire length of the first edge of each surface element, wherein the tool has insertion means for introducing the installation means of the vapor barrier collar in a groove, which is adapted for receiving the installation means, and actuating means for actuating the tool, wherein the insertion means comprise a surface for exerting a pressure and for sliding on the installation means and are connected to the actuating means at at least one point.

From WO 01/43988 a writing instrument holder is known, which protects the body of a writing instrument and allows the user to use and maintain the writing instrument until it becomes too short to be otherwise used effectively. This writing instrument holder is formed by a container with an opening at the upper end, an opening at the lower end, a plurality of notches next to the opening at the lower end, and a longitudinal opening in the longitudinal direction of the container.

Practicable extensions, which allow the rapid, customary, and mostly intuitive use of shortened pencils without restrictions, are hardly known.

A pencil extension from the VELUX company, which consists of plastic, is very short with a length of approximately 7.5 cm and, in comparison to the pencil, a significantly larger, rectangular cross-sectional area, as a result of which the handling of particularly short pencils is not significantly improved.

In addition, this extension has an unfavorably shaped and difficult to move clip with which the previously described problems of insertion and accessibility are only partially solved.

SUMMARY OF THE INVENTION

The object of the invention is to propose a solution which permits rapid, customary, and mostly intuitive use of shortened pencils without restrictions.

This object is achieved by an extension for pencils with worn out leads according to the claims The solution according to the invention will be explained in more detail below with reference to FIGS. 1A to 2D.

These exemplary illustrations are based on a carpenter's pencil. The shape of the extension according to the invention must be adapted accordingly for all other pencils with worn leads.

DETAILED DESCRIPTION OF THE INVENTION

Figures 1A, 1B, 1C, 1D, 1E:
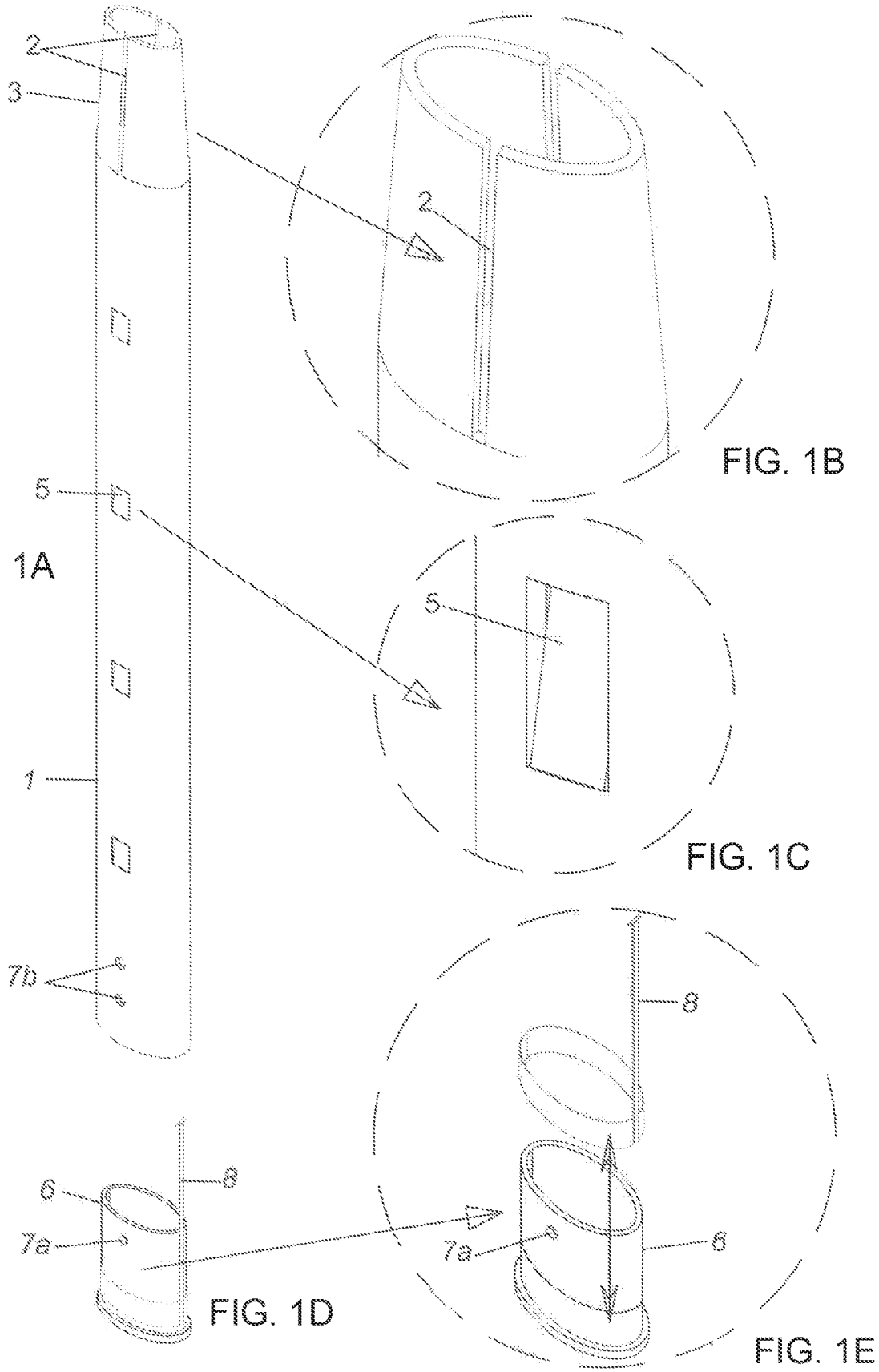
FIG. 1A shows the extension for pencils with worn leads.
FIG. 1B shows the lower, open end of the extension for pencils with worn leads with the detail of, for example, two slots 2 of appropriate length in the longitudinal direction in the surface of the sheath.
FIG. 1C shows in detail a retaining spring 5.
FIG. 1D shows in detail the cap 6 with the part of the catch 7*a* arranged on the cap 6 and the clip 8 in the joined position.
FIG. 1E shows in detail the cap 6 with the part of the catch 7*a* arranged on the cap 6 and the clip 8 in the unjoined position.
Figure 2A:
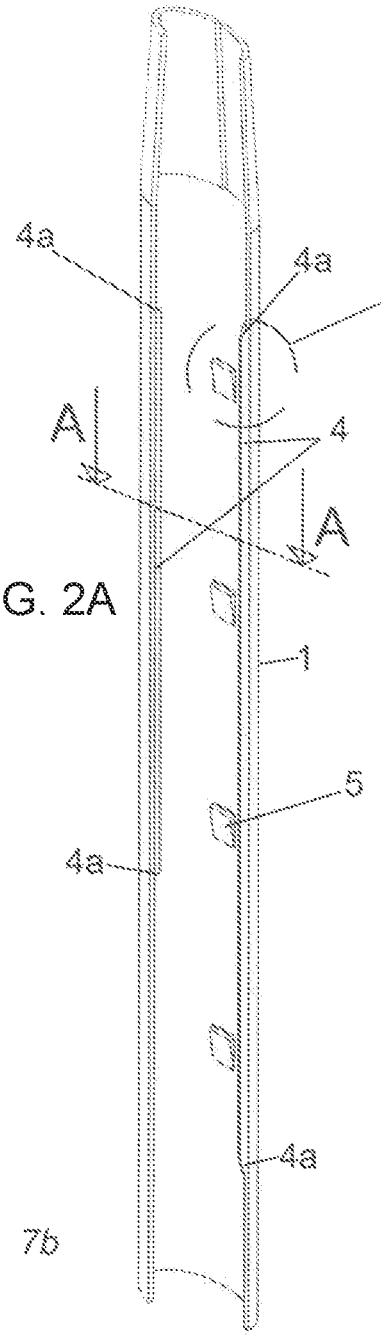
FIG. 2A shows a longitudinal section of the extension for pencils with worn leads.
Figure 2B:
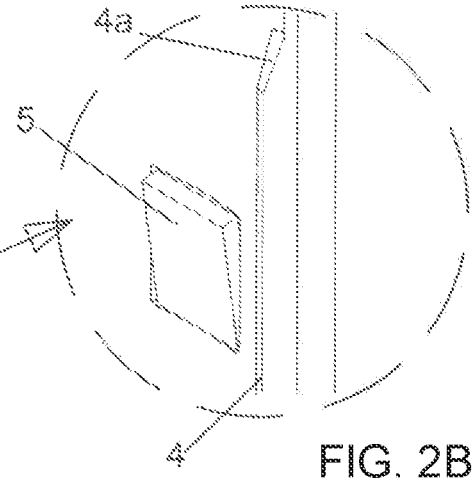
FIG. 2B shows in detail a retaining spring 5.
Figure 2C:
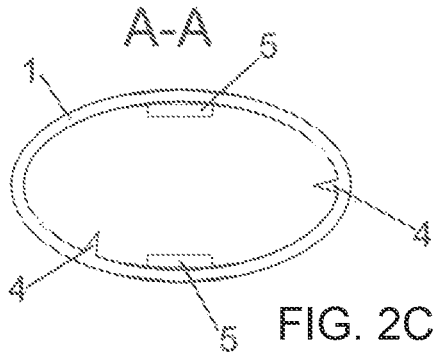
FIG. 2C shows a cross section A-A of the extension for pencils with worn leads.
Figure 2D:
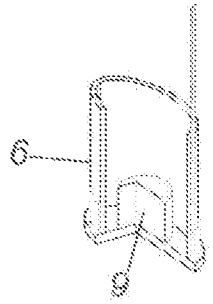
FIG. 2D shows a cross section through the cap 6 with a visible magnet 9.

The extension for carpenter's pencils is preferably realized by a thin-walled hollow profile made of plastic with a suitable length, the inner cross section of which is adapted to the shape of the common pencil cross sections.

To facilitate insertion, to compensate for manufacturing tolerances of the pencils with respect to the cross-sectional area, and for adequate fixing of the pencil in the extension, the above-mentioned features are expediently combined.

As a first feature, the extension has one or more slots 2 at the lower open end of appropriate length in the longitudinal direction in the surface of the sheath and a slight, linear reduction 3 of the cross section approximately over the length of the slot or slots in the direction of the end.

In this context, lower means the side of the extension at which the pointed end of the pencil is located, and upper correspondingly means the other side.

In the extension, longitudinally directed elevations 4 are provided in the form of triangular, square and/or semicircular prisms, which are realized in a suitable number, arrangement and length as a function of the pencil cross-section.

The height of the raised sections 4, which can become larger to a certain degree in the direction in which the pencil is inserted, is selected in such a way that it slightly grooves the pencil during insertion.

To facilitate insertion, the height of the raised sections 4 on the side of the extension at which the pencil is introduced is reduced linearly to zero over an expedient length 4*a*.

If more than one raised section 4 is provided, they should not be symmetrical with respect to one another or have different cross sections, as a result of which, for example after a rotation of a non-round pencil through 180° about its longitudinal axis, new grooves are formed during renewed insertion and adequate fixing is maintained.

Another feature can be used when the pencil is inserted from the top into the extension and pulled out step-by-step, and in which the inner surface of the extension exhibits an expedient number and arrangement of inwardly bent or projecting small regions of the surface of the sheath of the extension, referred to here as retaining springs 5, which are connected to the remaining surface of the sheath on the side up to the upper extension end and are separated from the surface of the sheath in the remaining region. When inserting the pencil, these retaining springs 5 are pressed elastically outwards.

After the end of the pencil has passed through the extension, the retaining springs 5 move back to their original positions, as a result of which upwards movement of the pencil is prevented, and the latter can be used continuously and almost completely.

The upper open end of the extension can be closed with a lockable cap 6, the end face of which corresponds to the outer cross-sectional surface of the extension and on which there is a piece of a hollow profile which is arranged perpendicularly thereto, and which has an outer cross section which corresponds to the inner cross section of the extension, and which has a device for locking the cap 6 in the extension 1, comprising elements 7*a* and 7*b*, which are to be jointed together.

If necessary, a clip 8 can be pushed on and fixed between the extension 1 and the end face of the cap 6.

In a particular embodiment of the solution according to the invention, the arrangement of a magnet 9 in the cap 6 is proposed to lift small and difficult to access steel parts. This appears to be particularly expedient in the exemplary illustration of a carpenter's pencil.

The invention claimed is:

1. An extension for a pencil with a wearing lead, the extension comprising:

a thin-walled hollow profile forming a body of the extension, said body having an inner surface and an outer surface, and said body having a first end and a second end between a longitudinal direction of said body;

said body having an inner cross-section configured to accommodate the pencil, and said first end being configured to accommodate an insertion of the pencil into said body, and said second end being configured to project a writing end of the pencil;

a tapered end section of said second end having at least one slot extending in said longitudinal direction; said tapered end section having a slight linear reduction in said inner cross-section over the length of said at least one slot in said longitudinal direction;

at least one elevation arranged along at least a portion of said inner surface of said body in said longitudinal direction, said at least one elevation being configured to engage the pencil when the pencil inserted into said body;

said at least one elevation having a cross-sectional form selected from the group consisting of triangular, square, and semi-circular, and said at least one elevation being a plurality of elevations, said elevations being arranged asymmetrically on opposite sides of said inner surface of said body, and said elevations having different cross-sectional forms; and a plurality of retaining springs arranged on said inner surface of said body, said retaining springs being configured to accommodate an insertion of the pencil into said body and to prevent the pencil from movement in a direction opposite of a direction of insertion.

2. The extension for pencils with wearing leads according to claim 1, wherein said at least one elevation has an inwardly extending height that increases along said longitudinal direction toward said second end of said body.

3. The extension according to claim 1, further comprising:

a lockable cap for closing said first end of said body, said lockable cap having an end face with a circumference corresponding to a circumference around said outer surface of said body, a projection with a hollow profile extending perpendicularly from said end face, said projection having an outer circumference corresponding to an inner circumference of said inner surface of said body; and said projection having locking device configured to lock said lockable cap in said body, said locking device having a locking element configured to engage a further locking element on said body when said lockable cap is inserted into said first end of said body.

4. The extension according to claim 3, further comprising a clip arranged between said projection of said lockable cap and said inner surface of said body.

5. The extension according to claim 3, further comprising a magnet arranged in said lockable cap.

* * * * *